US009966705B2

(12) United States Patent
Maeda

(10) Patent No.: US 9,966,705 B2
(45) Date of Patent: May 8, 2018

(54) CABLE IMPLEMENTING ACTIVE CONNECTOR FOR MODULATING DIFFERENTIAL SIGNALS BY PAM CONFIGURATION

(71) Applicant: Sumitomo Electric Industries, Ltd., Osaka-shi (JP)

(72) Inventor: Yasuhiro Maeda, Yokohama (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 100 days.

(21) Appl. No.: 14/864,553

(22) Filed: Sep. 24, 2015

(65) Prior Publication Data

US 2016/0093986 A1 Mar. 31, 2016

(30) Foreign Application Priority Data

Sep. 25, 2014 (JP) ..... 2014-195500

(51) Int. Cl.
*H01R 13/66* (2006.01)
*H01R 13/6461* (2011.01)

(52) U.S. Cl.
CPC ..... *H01R 13/665* (2013.01); *H01R 13/6461* (2013.01)

(58) Field of Classification Search
CPC ..... H04B 17/14; H04B 2001/0416; H04L 49/109
See application file for complete search history.

(56) References Cited

U.S. PATENT DOCUMENTS

2003/0034855 A1* 2/2003 Wallace, Jr. ..... H04B 3/28 333/12
2003/0040222 A1* 2/2003 Price ..... H01R 27/02 439/638
2012/0176756 A1* 7/2012 Gailus ..... H01R 13/6633 361/752
2013/0005193 A1* 1/2013 Tsai ..... H01R 13/6315 439/676
2015/0037047 A1* 2/2015 Barnett ..... H04B 10/25 398/186

FOREIGN PATENT DOCUMENTS

JP 2005-135840 A 5/2005

* cited by examiner

*Primary Examiner* — Freshteh A Aghdam
(74) *Attorney, Agent, or Firm* — Venable LLP; Michael A. Sartori; Laura G. Remus

(57) ABSTRACT

An intelligent cable is disclosed. The cable provides a connector and a metal core. The connector is pluggably coupled with an external apparatus and enclosing a circuit unit electrically connected to an external apparatus. The metal core is electrically connected to the circuit unit in the connector. The circuit unit includes a transmitter and a receiver. The transmitter receives input signals from the external apparatus and outputs a transmitted signal to the metal core. The receiver receives the transmitted signal from the metal core and provides output signals to the external apparatus. A feature of the cable is that the transmitter modulates the input signals and the receiver de-modulates the transmitted signal both by the PAM configuration.

10 Claims, 11 Drawing Sheets o-ch1
o-ch2
s-ch1
s-ch2
14f
14e
14
16d
14g
14h
14b
14a
16c
16b
16a
14c
14d
12
123
122
13a
13A
15b
15A
21a
21
16f
16e
15a s-ch3
s-ch4
o-ch3
o-ch4
14b
14a
16a
16b
16c
16d
14c
14d
14f
14e
14g
14h
13b
13A
15a
15B
21a
21

CABLE IMPLEMENTING ACTIVE CONNECTOR FOR MODULATING DIFFERENTIAL SIGNALS BY PAM CONFIGURATION

BACKGROUND OF THE INVENTION

1. Field of the Invention

The present application relates to a cable that implements an active connector for modulating differencial signals by the pulse-amplitude-modulation (RAM) configuration.

2. Background Arts

A Japanese Patent Application laid open No. 2005-135840A has disclosed a cable implementing connectors in respective ends thereof, where the connectors installs circuits to reshape signals to be transmitted and/or received.

Recent electronic systems, such as those connecting servers, storages, and/or switches in a datacenter, often implement a cable provided with active connectors. Conventionally, twisted pair cables, twin-Ax cables, and/or coaxial cables have been widely used for connecting such apparatuses of the servers and so on. Such cables transmit a differential signal output from the apparatus to another apparatus as keeping the configuration of the differential signal by a pair of metal cores constituting the twisted pair cable, the twinax cable, and so on.

An arrangement to transmit the differential signal by a paired cable inevitably requires a huge number of cables as increasing channels on which data are transmitted, which results in a thick cable containing a number of paired cables and degrades the flexibility thereof.

SUMMARY OF THE INVENTION

An aspect of the present application relates to a cable to transmit data as a transmitted signal. The cable comprises a connector and a metal core. The connector, which is pluggably coupled with an external apparatus, provides a circuit unit electrically connected to a circuit within the external apparatus. The circuit unit includes at least one of a transmitter and a receiver. The transmitter receives input signals and outputs the transmitted signals to the metal core. The receiver receives the transmitted signals from the metal core outputs the output signals to the external apparatus. A feature of the cable of the present application is that the transmitter modulates the input signals by the pulse-amplitude-modulation (PPM) configuration and outputs the modulated signal to the metal core; while, the receiver de-modulates the transmitted signals coming from the metal core by the PAM configuration and outputs the de-modulated signal to the external apparatus as the output signals.

BRIEF DESCRIPTION OF THE DRAWINGS

The foregoing and other purposes, aspects and advantages will be better understood from the following detailed description of a preferred embodiment of the invention with reference to the drawings, in which.

DESCRIPTION OF EMBODIMENTS

Some embodiments of the present application will be described as referring to drawings. However, it is intended that the present invention is not limited to those particular embodiments and modification explicitly disclosed herein, but the invention include all embodiments falling within the scope of the appended claims. In the description of the drawings, numerals or symbols same with or similar to each other will refer to elements same with or similar to each other without duplicated explanations.

First Embodiment

Figure 1:
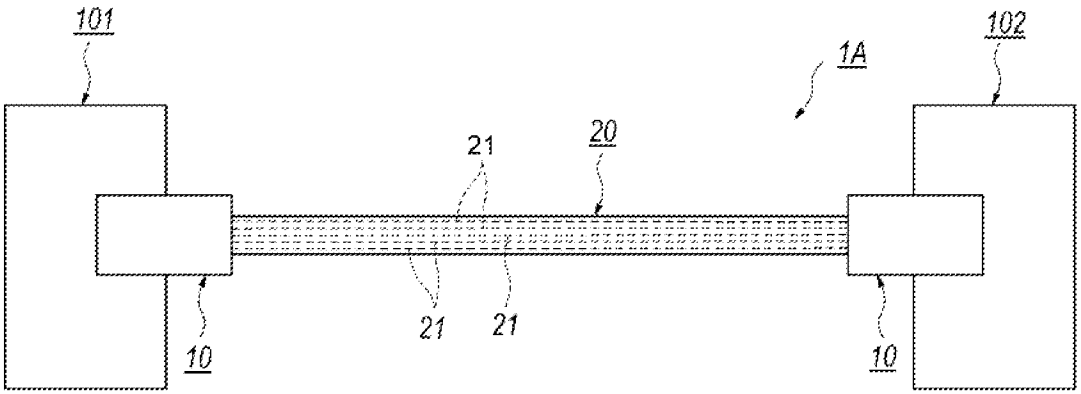
FIG. 1 schematically illustrates a cable for transmitting data according to an embodiment of the present invention.

FIG. 1 schematically illustrates a cable 1A according to an embodiment of the present invention. As shown in FIG. 1, the cable 1A comprises a cable bundle 20 and two connectors 10 each attached to respective ends of the cable bundle 20. The cable bundle 20 includes a plurality of coaxial cables 21. One of connectors 10 is to be plugged with an external apparatus 101 and electrically connected thereto. The other connector 10' is also no be plugged with other external apparatus 102 to constitute the electrical connection thereto. The description below concentrates on an arrangement that the cables within the cable bundle 20 are the type of the coaxial cable. However, the bundle cable 20 may include, for instance, a type of the twin-Ax cable and/or the twisted pair cable.

Figure 2:
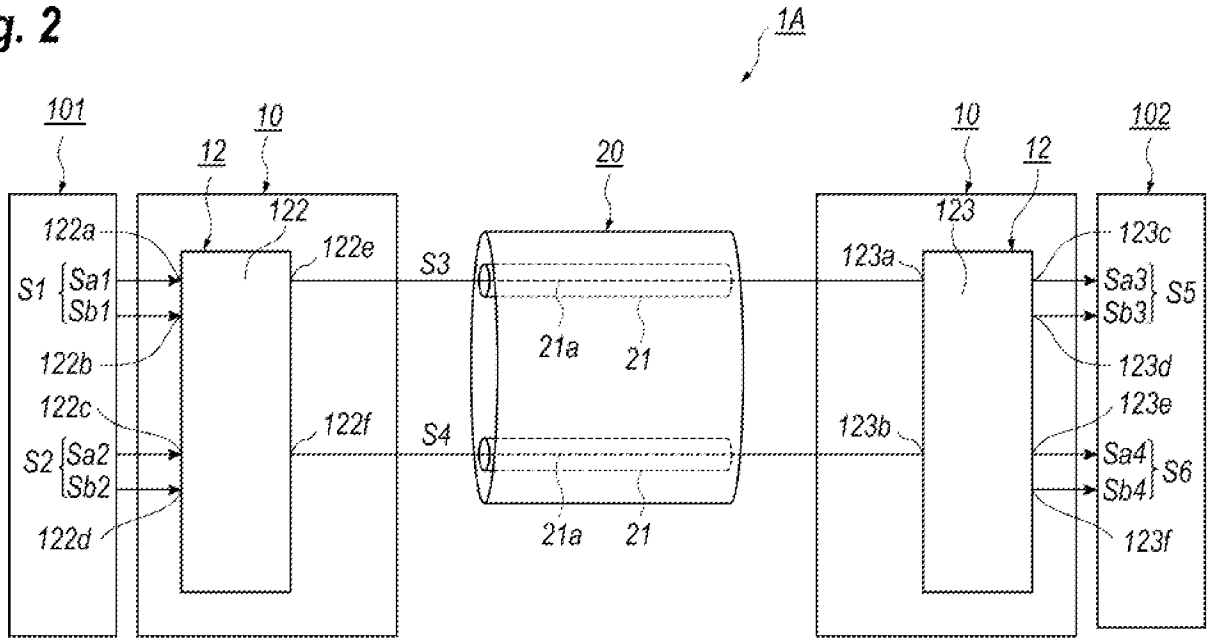
FIG. 2 schematically shows a block diagram of a portion of the cable of the first embodiment of the present application.

FIG. 2 schematically shows a functional block diagram of the cable 1A. Two connectors 10 each provides a circuit unit 12, which may include a signal shaper such as a clock data recovery (CDR), a repeater, and so on, with a type of an integrated circuit (IC) 121. The circuit unit 12 in one of the connectors 10 is electrically connected to the external apparatus 101 by plugging the connector 10 with the external apparatus 101, and the circuit unit 12 in the other of the connectors 10 is also coupled with the external apparatus 102 by plugging the other connector 10 with the external apparatus 102.

The circuit unit 12 includes a transmitter 122 and a receiver 123. The embodiment shown in FIG. 2 has an arrangement that the circuit unit 12 in the one of the connectors 10 provides only the transmitter 122 and the other circuit unit 12 in the other of the connectors 10 includes only the receiver 123 for the explanation sake. However, the circuit unit 12 in respective connectors 10 may provide both the transmitter 122 and the receiver 123.

Figure 3A:
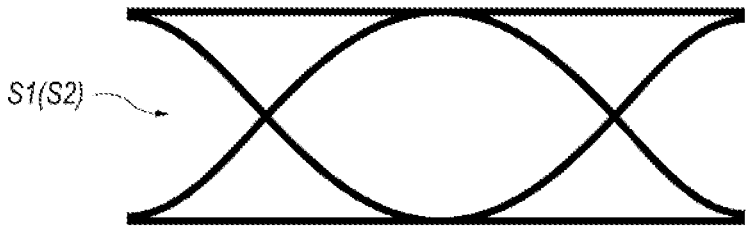
FIG. 3A schematically shows an eye diagram of an input signal of the cable, and FIG. 3B schematically shows an eye diagram of a transmitted signal of the cable, which is modulated by the pulse amplitude modulation (PAM) configuration.

The transmitter 122 receives an input signal S1 in a pair of input terminals, 121*a* and 121*b*, and another input signal S2 in another pair of input terminals, 121*c* and 121*d*. The input signals, S1 and S2 have a configuration of a differential signal including positive phase signals, Sa1 and Ss2, and negating phase signals, Sb1 and Sb2. The input signals, S1 and S2, constitute the signal channels. FIG. 3A schematically illustrates an eye diagram of the differential, signal. The input signals, S1 and S2, which enters the transmitter 122, have a type of the NRZ (Non-Return to Zero) signal attributed to two logic levels of HIGH(1) and LOW(0) by an amplitude therebetween. Thus, the input signals, S1 and S2, each contain information corresponding to one (1) bit because of two logic levels.

Figure 3B:
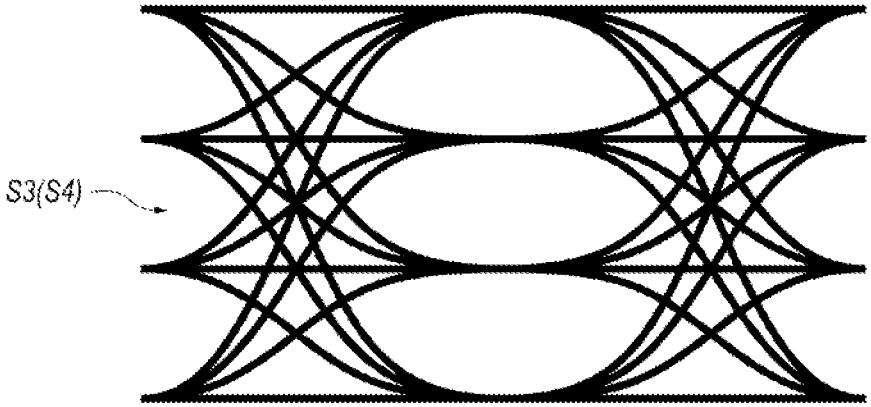

The transmitter 122 reshapes the input signals, S1 and S2, to output the transmitted signals, S3 and S4. Specifically, the transmitter 122 multiplexes the positive phase signals and the negative phase signals of the input signals, S1 and S2. Accordingly, the transmitted signals, S3 and 34, become amplitude multiplexing signal having greater multiplicity compared with the input signals, S1 and S2. The transmitted signal S3 multiplexes the positive phase signals, Sa1 and Sa2, while, the other transmitted signal S4 multiplexes the negative phase signals, Sb1 and Sb2. Thus, the transmitted signals, S3 and S4, constitute a differential configuration. FIG. 3B snows an example of an eye diagram of the transmitted signals, S3 and S4. As shown in FIG. 3B, the transmitted signals, S3 and S4, are a type of the PAM-4 (4-level Pulsed Amplitude Modulation) configuration having four (4) logic levels. That is, the lowest level corresponds to a condition where both of the input signals, S1 and S2, become LOW level, next lower level corresponds to a second condition where the input signal S1 becomes HIGH but the other input signal S2 is set LOW, the next level corresponds to a third condition where the input signal S1 is set LOW but the other input, signal S2 becomes HIGH, and the highest level corresponds to a fourth condition where both input signals, S1 and S2, become HIGH. Accordingly, the transmitted signals, S3 and S4, constituting the differential arrangement contain information corresponding to two (2) bits.

The transmitted signals, S3 and S4, are output to the output terminals, 122*e* and 122*f*, where former terminal 122*e* is electrically connected to a metal core 21*a* of one of the coaxial cables in the cable bundle 20, while, the other output terminal 122*f* is connected to a metal core 21*a* of another of the coaxial cables in the cable bundle 20. These coaxial cables 21 are coupled with the connector 10 of the receiver 123. The receiver 123 provides a pair of input terminals, 123*a* and 123*b*, the former of which is connected to the output terminal 122*e* of the transmitter 122 through the metal core 21*a*, while, the latter 123*b* is connected to the output terminal 122*f* through the metal core 21*a* of the another coaxial cable.

The receiver 123 outputs an output signal S5 from a pair of output terminals, 123*c* and 123*d*, and another output signal S6 from another pair of output terminals, 123*e* and 123*f*. That is, the receiver 123 demodulates the transmitted signals, S3 and S4, to recover the output signals, S5 and S6, where the former output signal S5 is a differential signal containing a positive phase signals Sa3 and a negative phase signal Sb3, while, the latter output signal S6 is also a differential signal containing another positive phase signal Sa4 and another negative phase signal Sb4. Thus, the output signals, S5 and S6, each correspond to the input signals, S1 and S2. The output signals, S5 and S6, are provided to an external apparatus 102.

Figure 4:
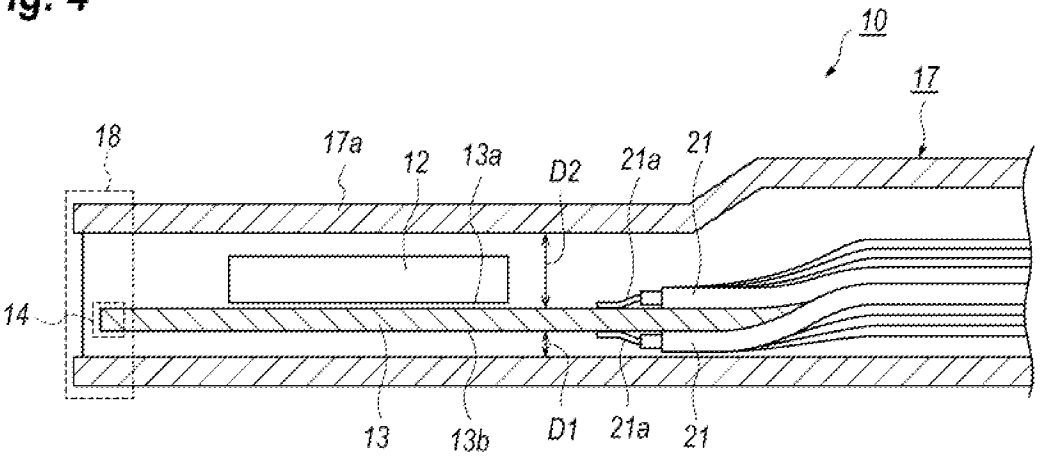
FIG. 4 shows a side cross section of a connector of an embodiment of the present invention.
Figures 5A, 5B:
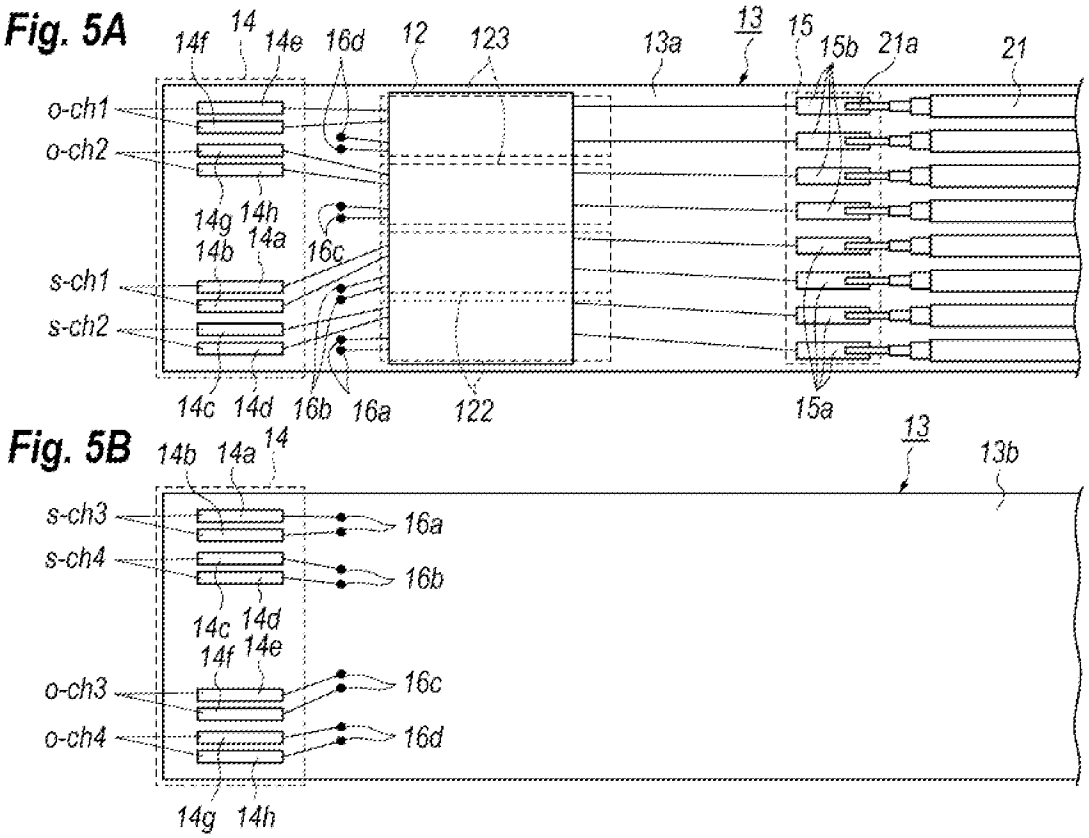
FIG. 5A schematically shows an arrangement of a top surface of a circuit board of the present embodiment, and FIG. 5B schematically shows a back surface of the circuit board.
Figures 6A, 6B:
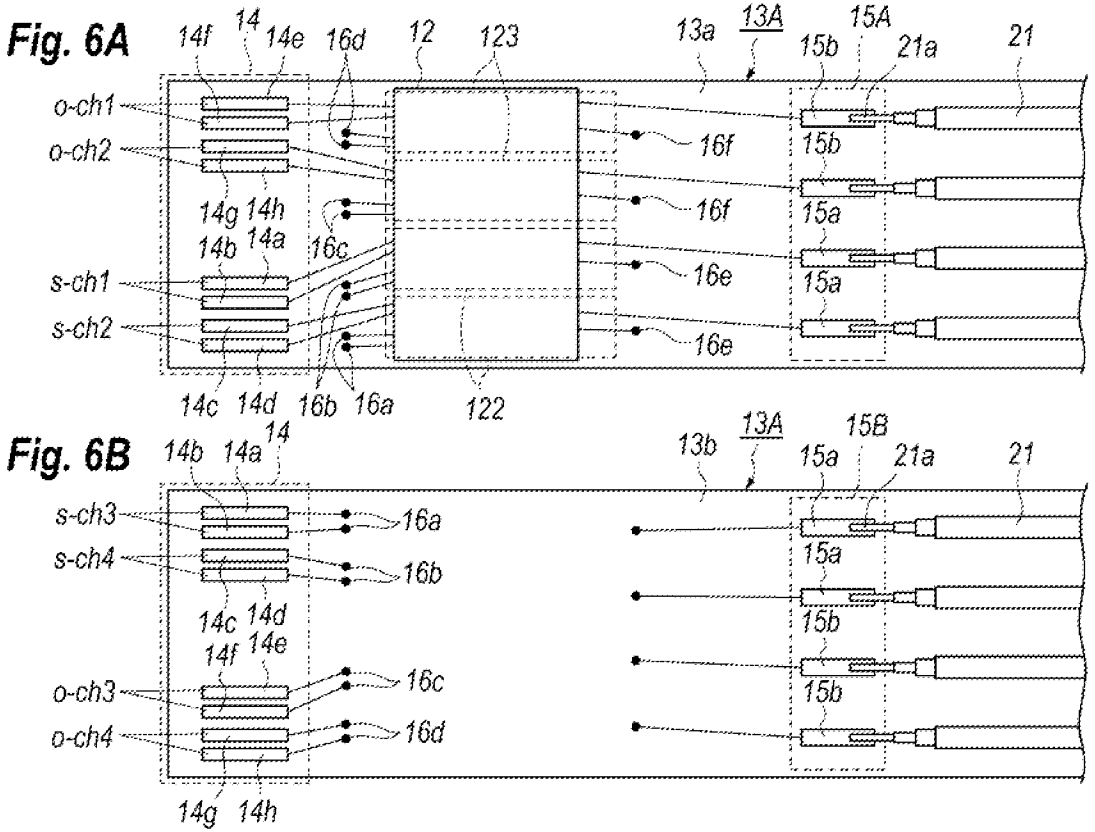
FIG. 6A schematically shows another arrangement of the top surface of the circuit board, and FIG. 6B schematically shows another arrangement of the back surface of the circuit board.

FIG. 4 shows a cross section and FIG. 6 shows a plan view of the connector 10 of the present embodiment, where FIG. 5A shows a top surface 13*a* of the circuit board 13 and FIG. 5B shows a back surface 13*b* of the circuit board 13. The connector 10 of the present embodiment provides the circuit board 13, which has a rectangular plane shape, including a ceramic, substrate and interconnections formed on top and back surfaces of the ceramic substrate. The circuit board 13 provides an area for mounting the circuit units 12 thereon, an interface 14 electrically connected to the circuit unit 12 and another interface 15 coupled with the coaxial cables 21. In the present embodiment shown in FIGS. 5A to 6B, the area for mounting the circuit unit 12 is provided in only the top surface 13*a* of the circuit board 13. The circuit unit 12 includes two transmitters 122 and two receivers 123 to receive four signals, s-ch1 to s-ch4, and output other four signals, O-ch1 to O-ch4. These signals, s-ch1 to s-ch4 and O-ch1 to O-ch4, are differential signals. Some of four signals, s-ch1 to s-ch4, may be same as the input signals, S1 and S2.

The interface 14 includes a plurality of terminals, 14*a* to 14*b*. Specifically, the top and back surfaces, 13*a* and 13*b*, of the circuit board 13 each provide the four paired terminals, 14*a* and 14*b*, 14*c* and 14*d*, 14*e* and 14*f*, and 14*g* and 14*h*. The former four terminals, 14*a* to 14*d*, are provided in a side where the transmitters 122 are mounted, while, the latter four terminals, 14*e* to 14*h*, are provided in another side where the receivers 123 are mounted.

In the top surface 13*a* of the circuit board, the first pair of terminals, 14*a* and 14*b*, and the second pair of the terminals, 14*c* and 14*d*, receive the input signals, s-ch1 and s-ch2. In the back surface 13*b* of the circuit board 13, the first pair of the terminals, 14*a* and 14*b*, and the second pair of the terminals, 14*c* and 14*d*, receive the input signals, s-ch3 and s-ch4, respectively but couple with the transmitters 122 in the top surface 13*a* of the circuit board 13 through via holes, 16*a* and 16*b*. Two pairs of terminals, 14*e* and 14*f*, and 14*g* and 14*h*, in the top surface 13*a* are coupled with the receivers 123 and output the output signals, o-ch1 and o-ch2. Also, rest two pairs of terminals, 14*e* and 14*f*, and 14*g* and 14*h*, in the back surface 13*b* are coupled with the receivers 123 on the top surface 13*a* through respective via holes, 16*c* and 16*d*, and output the output signals, o-ch3 and o-ch4. Thus, the terminals formed in the back surface 13*b* of the circuit board 13 may be electrically coupled with the circuit unit 12 in the top surface 13*a* through respective via holes, 16*a* to 16*d*. As described above, the circuit unit 12 provides two transmitters 122 which collectively have four input terminals and two output terminals. One of the transmitters 122 receives two input signals, s-ch1 and s-ch3, and generates one transmitted signal in the output terminal thereof. The other transmitter 122 receives two input signals, s-ch2 and s-ch4, and generates one transmitted signal in the output terminals thereof.

Terminals, 14*e* to 14*h*, in the top and back surfaces, 13*a* and 13*b*, of the circuit board 13 are provided for out putting signals and connected to output terminals of the receiver 123 such as terminals 123*c* to 123*f* shown in FIG. 2. The terminals, 14*e* to 14*h*, output the output signals, o-ch1 to o-ch4, each having the differential configuration. Specifically, the terminals, 14*e* and 14*f*, in the top surface 13*a* output the output signals o-ch1 and the terminals, 14*g* and 14*h*, also provided in the top surface 13*a* output the output signals o-ch2. The terminals, 14*e* and 14*f*, in the back surface 13*b* of the circuit board 13 output the output signals o-ch3, and the terminals, 14*g* and 14*h*, also provided in the back surface 13*b* output the output signals o-ch4. The terminals, 14*e* and 14*h*, in the back surface 13*b* are connected to one of the receivers 123 through the via holes 16*c*, while, the terminals, 14*g* and 14*h*, in the back surface 13*b* are connected to the other of the receivers 123 through the via holes 16*d*. Thus, the terminals, 14*e* to 14*h*, in the back surface 13*b* couple with the receiver 123 implemented on the top surface 13*a* of the circuit board 13. The receivers 123 in the circuit unit 12 each provide two input terminals and four output terminals. One of the receivers 123 generates the two output signals, o-ch1 and o-ch3, each having the differential arrangement by receiving one transmitted signal with the differential arrangement. Similarly, the other receiver 123 also generates the two output signals, o-ch2 and o-ch4, each having the differential arrangement by receiving one transmitted signal with the differential arrangement.

The interface 15 includes four pads 15*a* and other four pads 15*b* both provided in the top surface 13*a*. These pads, 15*a* and 15*b*, are connected to respective metal cores 21*a* of the coaxial cables 21. The coaxial cables 21 are provided only in the side of the top surface 13*a* of the circuit board 13. The pads, 15*a* and 15*b*, have a width 1.1 to 3.0 times greater than a diameter of the metal core 21*a*, preferably, 1.2 to 2.0 times greater than the diameter of the metal core 21*a*. The pads, 15*a* and 15*b*, preferably has a span to the neighbors greater than the width thereof. The pads 15*a* are provided for transmitting the transmitted signals. Specifically, four pads 15*a* are connected at least in the AC mode to the output terminals of the transmitter 122. The other four pads 15*b* are provided for receiving the transmitted signals and connected at least in the AC mode to the input terminals of the receiver 123.

The connector 10 further provides a housing 17 that encloses the circuit unit 12 and the circuit board 13. The housing 17 has a box shape extending along a longitudinal direction of the circuit board 13. The housing 17 provides a lid 17*a* facing the top surface 13*a* of the circuit board 13 and a bottom 17*b* facing the back surface 13*b* of the circuit board 13. A front of the housing 17 has an opening that forms an electrical connector 18 accompanying with the terminals 14. A rear of the housing 17 outputs the coaxial cables 21. In the present embodiment, a space D1 between the back surface 13*b* of the circuit board 13 and the bottom 17*b* of the housing is narrower than a space D2 between the top surface 13*a* of the circuit board 13 and the lid 17*a*.

Advantages of the cable 1A of the present embodiment will be described. The data transmission between external apparatuses, 101 and 102, are performed by the differential signal. The cable 1A of the embodiment receives the differential signals, S1 and S2, from the external apparatus, 101 or 102, and the transmitter in the cable 1A modulates the differential signals, S1 and S2, by the PAM configuration to generate the transmitted signals, S3 and S4, with the type of the differential signal, and output the transmitted signals, S3 and S4, to the metal cores 21*a*. This arrangement may reduce a number of the metal cores 21*a* within the cable 1A. Thus, the cable 1A may be formed in thin and flexible enough even the cable 1A includes a large number of metal cores 21*a*. Also, even when the metal cores 21*a* are formed in thick to reduce the transmission loss, the flexibility of the cable 1A may be maintained. The reduction of the number of the metal cores 21*a* may enhance the productivity or the soldering or the metal cores 21*a* to the pads, 15*a* and 15*b*, on the circuit board 13.

Also, the transmitter 122 provides a pair of output terminals, 122*e* and 122*f*, and the receiver 123 provides a pair of input terminals, 123*a* and 123*b*. The output terminals, 122*e* and 122*f*, may output a transmitted signal having the differential arrangement, and the input terminals, 123*a* and 123*b*, may receive a transmitter signal having the differential arrangement.

Only one of the surfaces 13*a* of the circuit board 13 may provide the pads, 15*a* and 15*b*. The coaxial cables 21 are soldered to the pads provided only in one of the surfaces, which may simplify the process to assemble the cable 1A. One type of conventional modules, which is often called as QSFP (Quadrature Small Form factor Pluggable) module, arranges the coaxial cables in both surfaces of the circuit board, which makes hard to assemble electronic components in respective sides of the circuit board when the circuit board is arranged offset from a center of the housing 17, that is, a distance D2 between the back surface 13*b* of the circuit board 13 to an inner surface of the housing 17 is set narrower than a distance D1 between the top surface 13*a* to another inner surface of the housing 17. Even when the circuit board 17 is so arranged, the coaxial cables 21 may be soldered only to the top surface 13*a* of the circuit board 13. Also, the circuit board 13 may mount all the circuit units 12 only on the top surface 13*a* thereof. This arrangement may simplify the process to mount the circuit units 12 on the circuit board 13 and may leave a space in the back surface 13*b* for mounting other electronic components thereon.

First Modification

FIG. 6A schematically illustrates a top view of the circuit board 13A modified from the circuit board 13 of the first embodiment, and FIG. 6B illustrates a back surface of the circuit board 13B. The circuit board 13A provides, substituted from the interface 15 of the first embodiment, interfaces, 15A and 15B, mounted on the top surface 13*a* and the back surface 13*b*, respectively. The interface 15A in the top surface 13*a* provides two pads 15*a* of the transmission and other two pads 15*b* for the reception. The other interface 15B in the back surface 13*b* also provides two pads 15*a* for the transmission and other two pads 15*b* for the reception.

The pads 15*a* are electrically connected to the output terminals 122*e* of the transmitter 122 in the AC mode through interconnections on the top surface 13*a*, and the other pads 15*a* in the hack surface 13*b* are electrically connected to the transmitter 122 in the top surface 13*a* in the AC mode through respective via holes 163 and the interconnections. The pads 15*b* in the top surface 13*a* are connected to the input terminals 123*a* of the receiver 123 through the interconnections in the AC mode, and the other pads 15*b* in the back surface 13*b* are connected to the input terminals 123*a* of the receiver 123 in the top surface 13*a* through the interconnections and the via holes 16*f*.

Because the pads, 15*a* and 15*b*, are provided in respective surfaces, 13*a* and 13*b*, the arrangement may expand spans between the pads, 13*a* and 13*b*, and between the metal cores 21, which may effectively reduce the crosstalk between the interconnections and the metal cores 21*a*. Also, the process to solder the metal cores 21*a* to the pads, 15*a* and 15*b*, may be simplified. Two types of the crosstalk may be taken into account, one type is the crosstalk between the input signals, the transmitted signals, and/or the output signals, and the other type is the crosstalk between the input signals and the transmitted signals, and between the transmitted signals and the output signals. The former type of the crosstalk is often called as the far end crosstalk (FEXT), while, the latter is called as the near end crosstalk (NEXT). The arrangement of the present modification may reduce both types of the crosstalk.

Second Modification

Figure 7A:
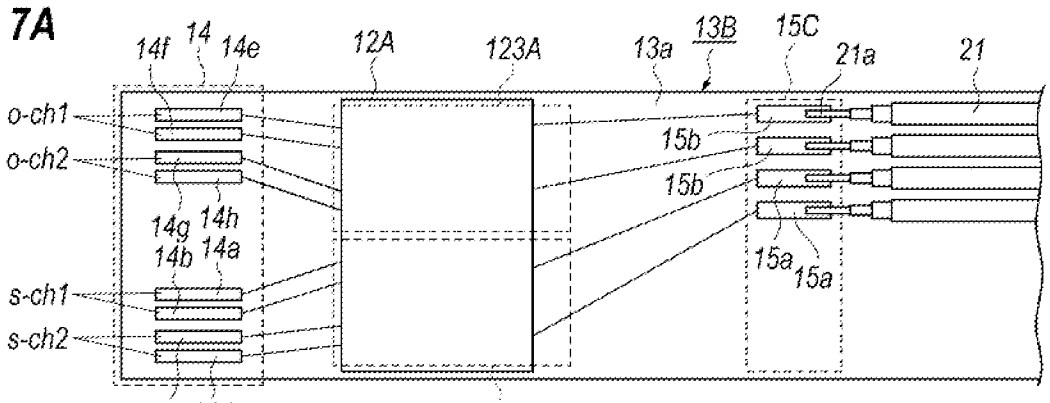
FIG. 7A schematically shows still another arrangement of the top surface of the circuit board, and FIG. 7B schematically shows still another arrangement of the back surface of the circuit board.
Figure 7B:
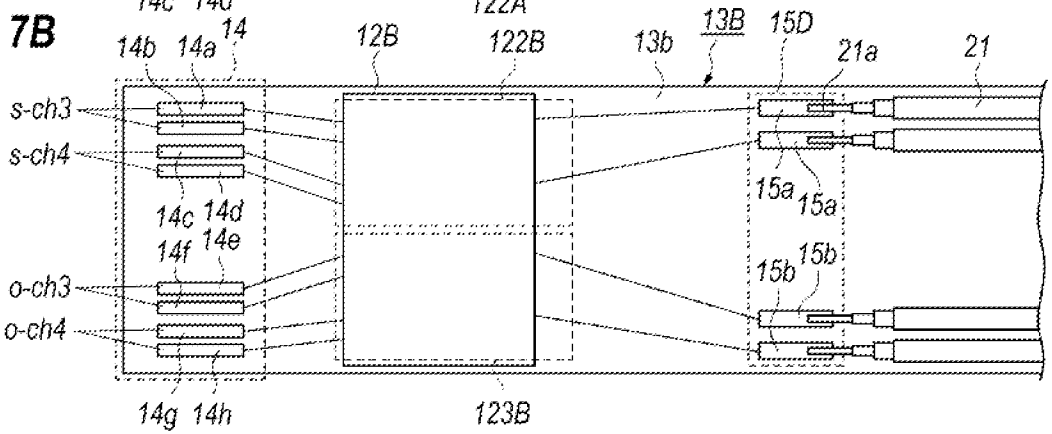

FIG. 7A schematically illustrates a plan view of the top surface 13*a* of the circuit board 13B and FIG. 7B illustrates the back surface 13*b* thereof modified from those shown in FIGS. 6A and 6B, respectively.

The circuit board 13B provides the circuit units, 12A and 12B, where the former is mounted on the top surface 13*a* and the latter is mounted on the back surface 13*b* of the circuit board 13B. The former circuit unit 12A includes both the transmitter 122A and the receiver 123A, and the latter circuit unit 12B includes both the transmitter 122B and the receiver 123B. The transmitter 122A in the top surface 13*a* is coupled with the terminals, 14*a* to 14*d*, in the top surface 13*a*, and the receiver 123A in the top surface 13*a* is coupled with the terminals, 14*e* to 14*h* in the top surface 13*a*. The transmitter 122B in the back surface 13*b* is coupled with the terminals, 14*a* to 14*d*, in the hack surface 13*b* and the receiver 123B in the back surface 13*b* is coupled with the terminals, 14*e* to 14*h*, in the back surface 13*b*.

Also, the circuit board 13B of the present modification provides the interfaces, 15C and 15D, where the former interface 15C is provided in the top surface 13*a* and the latter interface 15D is provided in the back surface 13*b*. The interface 15C in the top surface 13*a* includes two pads 15*a* coupled to the transmitter 122A through the interconnections and other two pads 15*b* coupled to the receiver 123A through the interconnections, where both interconnections are provided in the top surface 13*a*. The other interface 15D in the back surface 13*b* provides two pads 15*a* coupled to the transmitter 122B through the interconnections and other two pads 15*b* coupled to the receiver 123B through the interconnections. The pads, 15*a* and 15*b*, in the top surface 13*a* are arranged in one side of the circuit board 13*a* to leave a space in the other side, while, the pads, 15*a* and 15*b*, in the back surface 13*b* are arranged only in respective sides of the circuit board 13 to leave a space in a center of the circuit board 13. The spans between pads, 15*a* and 15*b*, in the top surface 13*a* and the bottom surface 13*b*, are set to be narrower than the spans between pads, 15*a* and 15*b*, in the aforementioned medication shown in FIGS. 7A and 7B.

The circuit board 13B of the present modification provides the circuit units, 12A and 12B, each including the transmitters, 122A and 122B, and the receivers, 123A and 123B, respectively; but, the circuit board 13B has no via holes, which may reduce a cost of the circuit board 13B. The arrangement of the pads, 15*a* and 15*b*, of the present modification may leave a space in another side of the top surface 13*a* and in a center of the back surface 13*b*, where additional electrical components may be mounted in those spaces.

Third Modification

Figures 8A, 8B:
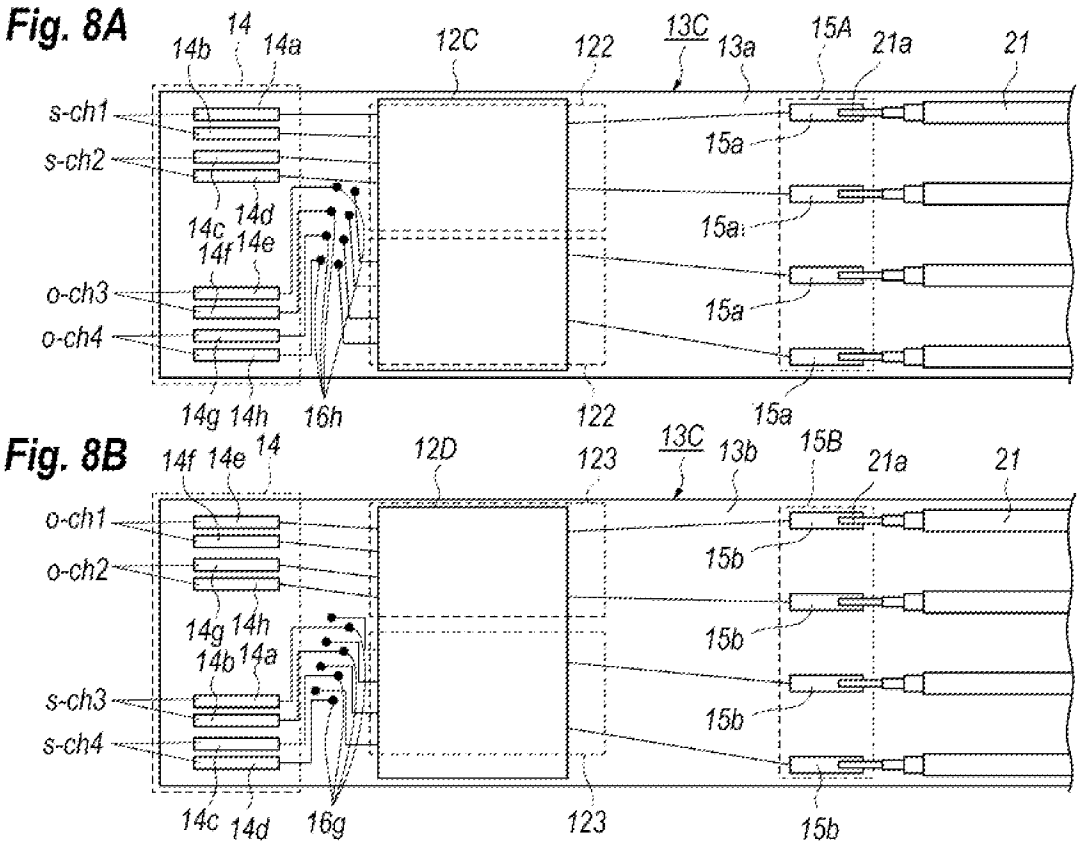
FIG. 8A schematically shows still another arrangement of the top surface of the circuit board.
FIG. 8B shows still another arrangement of the back surface of the circuit board.

FIGS. 8A and 8B schematically illustrate a plan view of the top surface 13*a* and the back surface 13*b* of the circuit board 13C according to the third modification of the aforementioned circuit board 13 shown in FIGS. 6A and 6B.

The circuit board 13C of the present modification provides the circuit units, 12C and 12D, instead of the circuit units, 12A and 12B, of the former modification shown in FIGS. 7A and 7B. The circuit unit 12C, which is provided on the top surface 13*a*, includes two transmitters 122, one of which is coupled with the terminals, 14*a* to 14*d*, in the top surface 13*a* through the interconnections and the other is coupled with the terminals, 14*a* to 14*d*, provided in the back surface 13*b* through the via holes 16*g* and the interconnections. The other circuit unit 12D, which is provided in the back surface 13*b*, includes two receivers 123, one of which is coupled with the terminals, 14*e* to 14*h*, in the back surface 13*b* through the interconnections, and the other is coupled with the terminals, 14*e* to 14*h*, in the top surface 13*a* through the via holes 16*h* and the interconnections. The circuit board 13C also provides the interfaces, 15A and 15B, in the top and back surfaces, 13*a* and 13*b*, respectively.

The circuit board 13C provides the transmitters 122 only in the top surface 13*a* thereof but the receivers 123 only in the back surface 13*b* thereof. That is, the circuit board 13C electrically isolates the receivers 123 from the transmitters 122 by the circuit board 13C, which may effectively reduce the near end crosstalk (NEXT).

Second Embodiment

Next, a cable for transmitting data according to the second embodiment of the present application will be described. Descriptions herein below will concentrate on portions distinguishable from those of the first embodiment. That is, arrangements in the first embodiment may be applicable to the second embodiment within technically available ranges.

Figure 9:
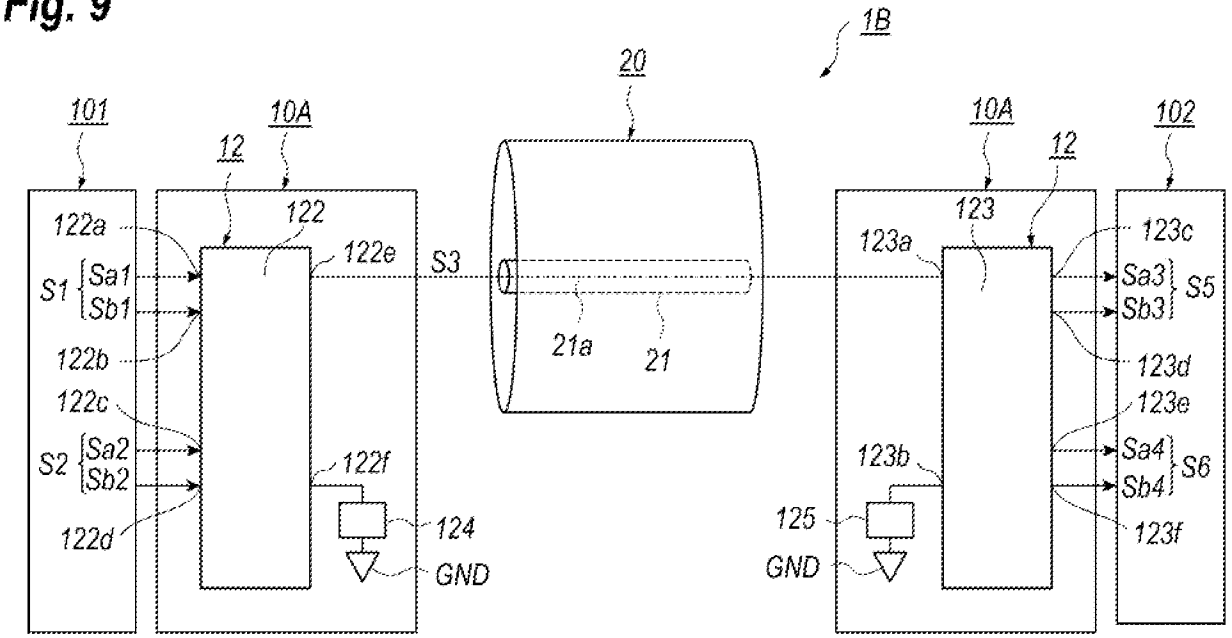
FIG. 9 schematically illustrates a block diagram of a portion of the cable according to the second embodiment of the present application.

FIG. 9 schematically illustrates a functional block diagram of the cable 1B for transmitting data. As illustrated in FIG. 9, the cable 1B in one of the connector 10A thereof provides a terminator 124 connected to the transmitter 122. The terminator 124, which may include a resistor with resistance of 50Ω and a capacitor connected in parallel to the resistor, is connected between one of the output terminals, 122*e* and 122*f*, of the transmitter 122 and the ground GND, or a the power supply line.

One of the transmitted signal, S3 or S4, generated in the transmitter 122 is terminated by the terminator 124, where FIG. 9 snows an example that the output terminal 122*f* to output the transmitted signal S4 is terminated. The other transmitted signal S3 is output to the metal core 21*a* of the coaxial cable 21. As described, the transmitted signal S3 is one of the positive phase signal and the negative phase signal of the differential arrangement, that modulates the input signal S1 and the other input signal S2 by the PAM configuration. That is, the transmitted signal S3 transmitted on the metal core 21*a* is the single-ended signal.

Figures 10A, 10B:
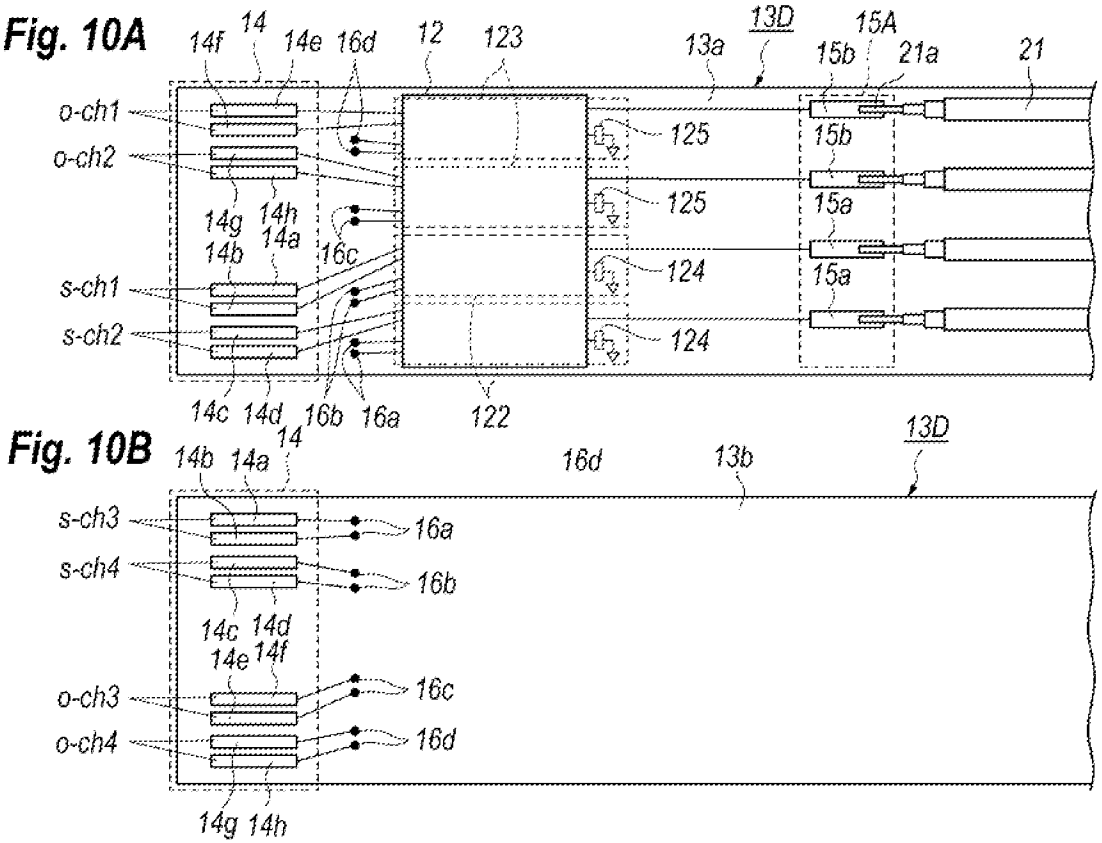
FIG. 10A schematically shows an arrangement of the top surface of the circuit board of the cable shown in FIG. 9, and FIG. 10B schematically shows an arrangement of the back surface of the circuit board of the embodiment.

The cable 1B further provides the other connector 10A also providing a terminator 125 connected to the circuit unit 12. That is, one of the input terminals, 123*a* and 123*b*, of the receiver 123 is terminated to the ground GND by the terminator 125. In FIG. 9, the input, terminal 123*b* is terminated. The terminator 125 may be terminated to a power supply line and so on inherently showing low impedance. The receiver 123 de-modulates the input signal S3, which comes from the metal core 21*b* and has the single-ended configuration, to the output signals, S5 and S6, and outputs these signals, S5 and S6, to the external apparatus as respective differential signals. FIG. 10A schematically shows a plan view of the top surface 13*a* of the circuit board 13D, and FIG. 10B is a plan view of the back surface 13*b* thereof. The top surface 13*a* provides the interface 15A that includes the pads, 15*a* and 15*b*, but the back surface 13*b* thereof provides no pads.

The cable 1B of the second embodiment may reduce the number of the metal cores 21*a*, compared with that, of the first embodiment, by transmitting the transmitted signals output from the transmitter 122 by the single-ended configuration, which brings that the pads, 15*a* and 15*b*, in the connectors 10A may widen the spans therebetween, and accordingly simplify the process to solder oho metal cores 21*a* to the pads, 15*a* and 15*b*.

Third Embodiment

Next, another cable for transmitting data according to the third embodiment of the present application will be described. The description below omits explanations for the elements and arrangements same with or similar to those of the aforementioned embodiment, and concentrates on portions distinguishable from those of the first and second embodiments. Descriptions for the first and second embodiments may be applicable to the third embodiment within their technically available ranges.

Figures 11A, 11B:
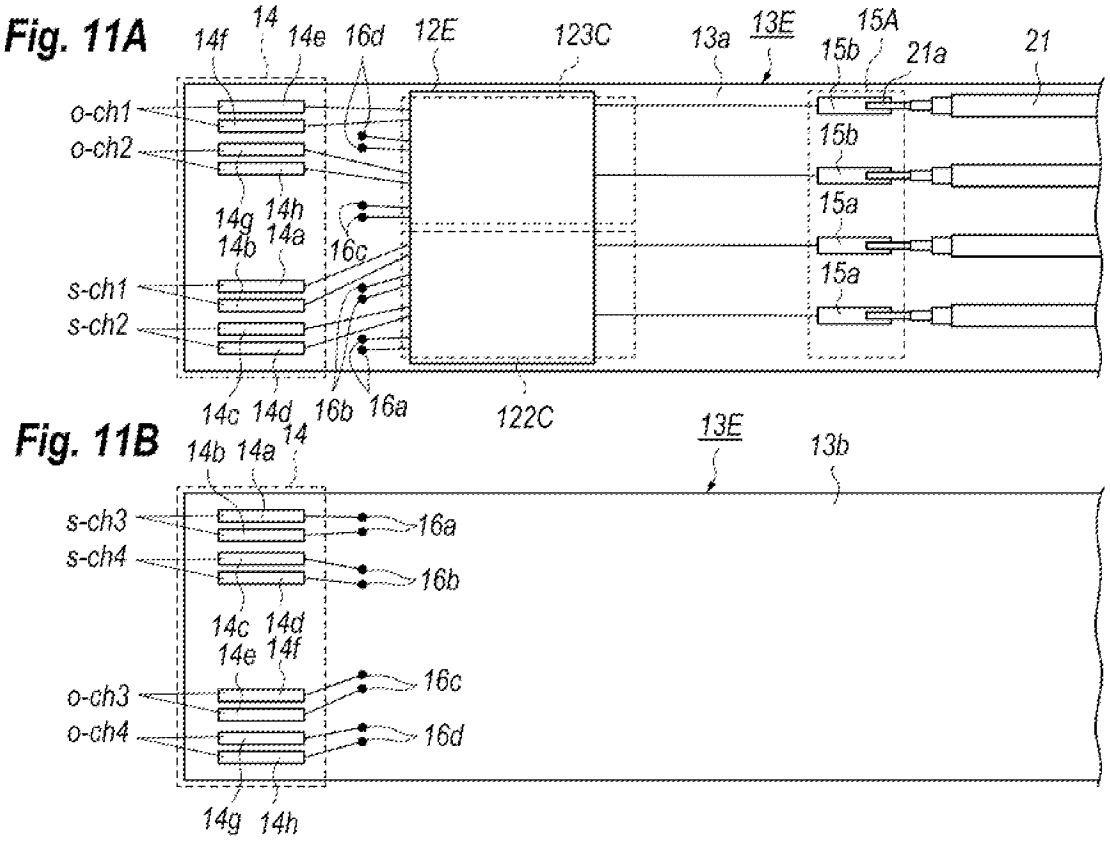
FIG. 11A schematically shows another arrangement of the top surface of the circuit board of the cable shown in FIG. 9.
FIG. 11B schematically shows another arrangement of the back surface of the circuit board.

FIG. 11A is a plan view of the top surface 13*a* of the circuit board 13E according to the present embodiment, while, FIG. 11B is a plan view of the back surface 13*b* thereof. The connector 10A provides the circuit unit 12E only in the top surface 13*a* of the circuit board 13E, where the circuit unit 12E includes both the transmitter 122C and the receiver 123C.

The transmitter 122C modulates the input signals, s-ch1 to s-ch4, into one PAM signal with the differential arrangement containing tow signals, S3A and S4A. Accordingly, the transmitter 122C provides eight (8) input terminals and two (2) output-terminals for outputting the differential transmitted signals, S3A and S4A. That is, the differential signal, S3A and S4A, has the PAM-16 configuration and includes the information expressed by four (4) bits.

The receiver 123C de-modulates the transmitted signal with the differential arrangement and having the PAM-16 configuration to generate four (4) output signals, o-ch1 to o-ch4. Accordingly, the receiver 123C provides two input (2) terminals and eight (8) output terminals. The cable according to the third embodiment may show the functions and advantages similar to and same with those of the aforementioned cables, 1A and 1B. Also, the cable according to the third embodiment transmits the transmitted signal by the differential configuration but, enhances the modulation degree thereof, which reduces the number of the metal cores 21*a* in the cable.

The cable for transmitting data according to the present invention is not restricted to those described above. Various modifications may be applicable. For instance, the connectors provided in respective ends of the cable may implement both the transmitter and the receiver, where a portion of the metal cores 21*a* is connected between the transmitter in one connection and the receiver in the other connector, and a rest portion of the metal cores is connector between the receiver in the one connector and the transmitter in the other connector. Thus, such a cable realizes the full-duplex communication. Also, the second embodiment of the present invention terminates one of the output terminals of the transmitter and one of the input terminals of the receiver to transmit the transmitted signals as the single-ended signal. However, various techniques except for those described above may be applicable to convert the differential signal to the single-ended signal and the single-ended signal to the differential signal. Therefore, it is intended that the present invention not be limited to the particular embodiments disclosed, but that the invention include all embodiments failing within the scope of the appended claims.

I claim:

1. A cable for transmitting a transmitted signal, comprising:

a connector that is pluggably coupled with an external apparatus, the connector providing a circuit unit electrically connected to a circuit in the external apparatus, the circuit unit including at least one of a transmitter and a receiver, the transmitter receiving input signals from the external apparatus and outputting the transmitted signal, the receiver receiving another transmitted signal and outputting output signals to the external apparatus; and a metal core connected to the at least one of the transmitter and the receiver in the circuit unit, the metal core being disposed within the cable, wherein the transmitter in the circuit unit modulates the input signals; outputs the modulated signal with a pulse amplitude modulation (PAM) configuration to the metal core as the transmitted signal; provides a pair of output terminals for outputting the transmitted signal as a differential arrangement terminates one of the output terminals; and transmits the transmitted signal from another of the output terminals to the metal core in an alternating current (AC) mode, wherein the receiver in the circuit unit de-modulates the another transmitted signal with the PAM configuration provided from the metal core to generate de-modulated signals; outputs the de-modulated signals to the external apparatus as the output signals; provides a pair of input terminals for receiving the another transmitted signal as the differential arrangement terminates one of the input terminals; and receives the another transmitted signal from the metal core through another of the input terminals in the AC mode, and wherein the transmitted signal and the another transmitted signal are a single-ended arrangement.

2. A cable for transmitting a transmitted signal, comprising:

a metal core involved within the cable; and a connector that is pluggably coupled with an external apparatus, the connector providing a circuit unit; a circuit board that includes an area for mounting the circuit unit; an interface electrically coupled with the external apparatus and the circuit unit; another interface that includes a pad electrically connected to the circuit unit and attaching the metal core thereto; and a housing that encloses the circuit unit and the circuit board therein, the circuit unit including at least one of a transmitter and a receiver connected to the metal core, wherein the transmitter in the circuit unit receives input signals, modulates the input signals to generate a modulated signal with a pulse amplitude modulation (PAM) configuration; and outputs the modulated signal to the metal core as the transmitted signal, wherein the receiver in the circuit unit receives another transmitted signal provided from the metal core, de-modulates the another transmitted signal with the PAM configuration to generate de-modulated signals; and outputs the de-modulated signals to the external apparatus as the output signals, and wherein the circuit board has a top surface and a back surface, the top surface forming a distance against an inner surface of the housing facing thereto that is greater than a distance of the back surface against another inner surface of the housing facing the back surface.

3. The cable of claim 2, wherein the circuit unit is mounted on only one of the top surface and the back surface of the circuit board.

4. The cable of claim 3, wherein the interface includes a portion of terminals mounted on the top surface of the circuit board and a rest portion of terminals mounted on the back surface of the circuit board, and wherein the portion of the terminals and the rest portion of the terminals are electrically coupled with the circuit unit mounted on one of the top surface and the back surface of the circuit board.

5. The cable of claim 2, wherein the another interface includes a plurality of pads mounted on only one of a top surface and a back surface of the circuit board.

6. The cable of claim 2, wherein the another interface includes a plurality of pads, a portion of the pads being provided on a top surface of the circuit board, and a rest portion of the pads being provided on a back surface of the circuit board.

7. The cable of claim 6, wherein the top surface of the circuit board arranges the portion of the pads in respective sides leaving a space in a center of the top surface, and the back surface of the circuit board arranges the rest portion of the pads in respective sides leaving another space in a center of the back surface.

8. A cable for transmitting a transmitted signal, comprising:

metal cores each connected disposed within the cable; and a connector that is pluggably coupled with an external apparatus, the connector providing a circuit unit, a circuit board, an interface, and another interface; the circuit board including an area for mounting the circuit unit, the interface being electrically coupled with the external apparatus, and the another interface including pads that are electrically connected with the circuit unit and attach the metal cores thereto; the circuit unit being electrically connected with a circuit in the external apparatus and providing a plurality of transmitters and a plurality of receivers, wherein the transmitters each receive input signals from the external apparatus; modulate the input signals to generate modulated signals with a pulse amplitude modulation (PAM) configuration; and output the modulated signals to the metal cores as transmitted signals, and wherein the receivers each receive another transmitted signals with the PAM configuration from the metal cores; de-modulate the another transmitted signals to generate output signals; and output the output signals to the external apparatus, wherein a top surface of the circuit board mounts the transmitters and a back surface of the circuit board mounts the receivers.

9. A cable for transmitting a transmitted signal, comprising:

metal cores each connected disposed within the cable; and a connector that is pluggably coupled with an external apparatus, the connector providing a circuit unit, a circuit board, an interface, and another interface; the circuit board including an area for mounting the circuit unit, the interface being electrically coupled with the external apparatus, and the another interface including pads that are electrically connected with the circuit unit and attach the metal cores thereto; the circuit unit being electrically connected with a circuit in the external apparatus and providing a plurality of transmitters and a plurality of receivers, wherein the transmitters each receive input signals from the external apparatus; modulate the input signals to generate modulated signals with a pulse amplitude modulation (PAM) configuration; and output the modulated signals to the metal cores as transmitted signals, and wherein the receivers each receive another transmitted signals with the PAM configuration from the metal cores; de-modulate the another transmitted signals to generate output signals; and output the output signals to the external apparatus, wherein a top surface of the circuit board mounts a portion of the transmitters and a portion of the receivers, and a back surface of the circuit board mounts a rest portion of the transmitters and a rest portion of the receivers.

10. The cable of claim 9, wherein the interface includes terminals and other terminals, the terminals being mounted on the top surface of the circuit board and electrically coupled with the portion of the transmitters and the portion of the receivers that are mounted on the top surface of the circuit board, and the other terminals being mounted on the back surface of the circuit board electrically coupled with the rest portion of the transmitters and the rest portion of the receivers that are mounted on the back surface of the circuit board.

* * * * *